XR 4,523,759

United States Patent [19]

Igarashi

[11] Patent Number: 4,523,759

[45] Date of Patent: Jun. 18, 1985

[54] GOLF CLUB

[76] Inventor: Lawrence Y. Igarashi, 27171 Hidden Trail Rd., Laguna Hills, Calif. 92653

[21] Appl. No.: 493,732

[22] Filed: May 11, 1983

[51] Int. Cl.[3] ..... A63B 53/08; A63B 53/06

[52] U.S. Cl. ..... 273/169; 273/167 H; 273/77 A; 273/186 R; 73/12; 73/649

[58] Field of Search ..... 273/167 H, 169, 171, 273/77 A, 186 R

[56] References Cited

U.S. PATENT DOCUMENTS

| | | | |
|---|---|---|---|
| 1,257,471 | 2/1918 | Fitzjohn et al. | 273/167 H |
| 1,453,503 | 5/1923 | Holmes | 273/171 |
| 4,429,879 | 2/1984 | Schmidt | 273/167 H |

FOREIGN PATENT DOCUMENTS

| | | | |
|---|---|---|---|
| 7279 | of 1901 | United Kingdom | 273/171 |

*Primary Examiner*—George J. Marlo

*Attorney, Agent, or Firm*—George F. Bethel; Patience K. Bethel

[57] ABSTRACT

A perimeter weighted hollow golfing iron having a foam core with an effective hitting area concentrated toward the center of moments is disclosed. The weight of the club is concentrated at the perimeter to provide for the center of moments and proximate effective hitting area over the core. The club is formed from an investment casting having a cavity and is made from a method whereby the club is originally cast with a tapered core which is later withdrawn. Thereafter, an end plate is implaced over the cavity and welded thereto with an opening for insertion of the foam with an epoxy plug filling the opening of the plate. An effective hitting area is established by means of a club holder having a transducer so that impacts through an impact device against the club face can be sensed by the transducer to provide signals to an output such as a CRT, digital or analog readout or oscilloscope.

5 Claims, 12 Drawing Figures

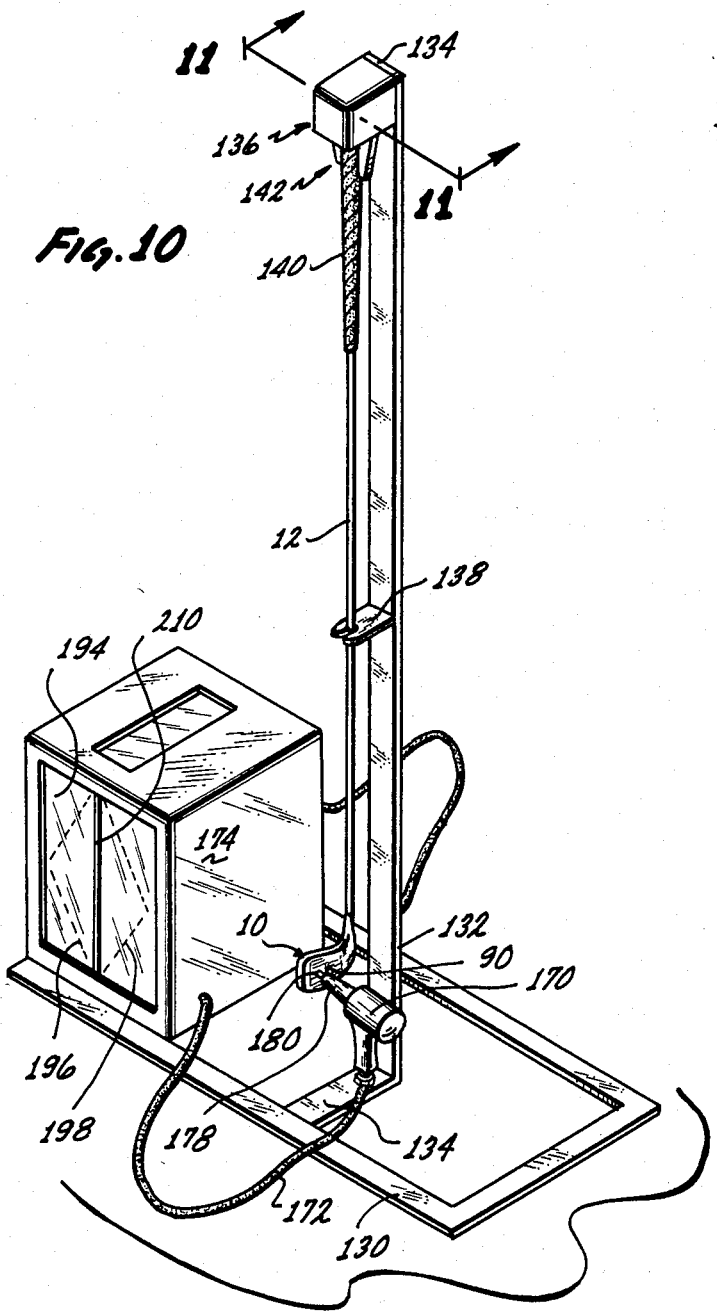
Fig. 10
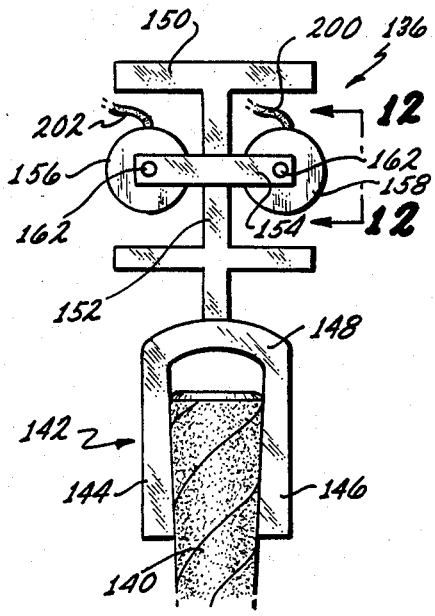
Fig. 11
Fig. 12
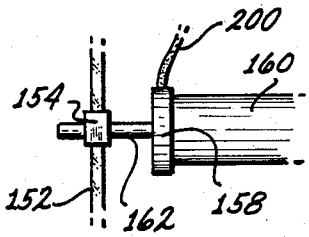

GOLF CLUB

BACKGROUND OF THE INVENTION

1. Field of the Invention

The field of this invention lies within the field of golf. More particularly, it lies within the field devoted to the design, manufacture and utilization of a golf club.

The field resides within the field not only of golf club design and utilization of golf clubs, but the manufacture of those clubs through improved manufacturing methods.

The overall effect of the disclosure herein is to provide a newly designed golf club, as well as an improved method for the manufacture thereof, all within the golf club field for improved golf club functions.

2. The Prior Art

The prior art with regard to properly weighted clubs was initiated over fifty years ago. The design efforts directed toward properly weighted clubs, and clubs that functioned in an improved manner was initially effectuated by having iron clubs made with a particular weighting that was suitable for a golfer's swing.

The weighting of the club and the design weight of the club specifically encompassed the general idea of maintaining a club swing weight which was comfortable during a prescribed swing. Not only was the effort to make the club swing weight comfortable, but it was to be balanced.

In ascertaining the balance of the club with regard to the swing weight, it was customary to provide a standard club and remove or add weight to it. During the removal process, the clubs could be ground. However, the weight adding process was generally done within the club shaft or hosel.

The way the weight was added in the hosel was that weight was actually placed within the hosel to provide for a prescribed swing. This measurably accounted for the balance of the entire club as to its relationship with regard to the club shaft and the head of the club. However, it did not account for the relationship of the club head with regard to the impact moment of the club head against the ball.

During the development of such golf clubs and methods for establishing balance, there were numerous attempts to provide the balance by way of certain shaft balancing machines. Some of these machines were akin to a central fulcrum that provided a movable weight for the proper balance of the club. Others prescribed certain centrifugral movements to the club with the shaft so as to allow for weighting in a proper manner for balance of the entire shaft with the club head.

The foregoing all establish the general balance of a club in combination with a shaft so that a person's desired swing weight was generally accommodated for. However, in no instance did they apply the principles of torque and moment with regard to impact moment for the club head.

At a later point in time, it was recognized that the impact of a club head against a ball provided a certain torque or moment if the center of moments was not properly impacted on the club head face. To this end, certain designs tried to effectuate a proper relationship of the club head face in its overall weighted characteristics with regard to the impact that would normally be encountered by a ball. In other words, when a ball impacted a club head and it was not at the center of moments, it caused a certain amount of torque or movement of the club head.

To accommodate for the torque or movement of the club head upon the impact of a ball, certain weighting was relied upon. Such weighting incorporated excess weight at the heel or the toe of the club. In such a weight relationship. when a ball was impacted at the toe or the heel through a faulty swing and golf shot, the torque or moment was not as great. This was due to the fact that there was a greater amount of mass at the particular point of impact, even though the point of impact was not at the center of moments. These designs have incorporated various weighting means that were on a permanently weighted basis to provide such offsets.

In some cases, the clubs have been provided with weighting means in the form of lead or shot applied to the toe or the heel. Also, there have been certain weighting efforts by changing the overall club head profile into various configurations. Such configurations encompassed the concept of moving the club head profile at various angles and relationships so that streamlining and balancing could be accomplished.

In other cases, designs incorporated a plastic backing behind a metal face or a plastic insert or other means for providing a less dense area with a more dense area in another discrete location.

In all of the foregoing designs, there has been no accommodation with respect to providing an effective hitting area consistently within the proximate area of the center of moments. This particular club provides an effective hitting area and a series of matched clubs. The clubs allow for a pre-established center of moments to be marked on the club and show the golfer where the center of moments and approximate effective hitting area is.

This invention accomplishes this by providing for a peripheral or perimeter weighting of the club. In order to allow for the peripheral or perimeter weighting while at the same time eliminating excessive swing weight, the club is made from an investment casting that is hollow and has an open end. The cavity or hollow portion is filled with a plastic, such as a urethane foam, polystyrene foam and the like, including other plastics.

The club is finished by means of a cap or cover over the open end that is welded or attached in any suitable manner over the cavity opening. The hollow portion of the club is retained by a core imposed therein during the investment casting process.

To further enhance the function of the club, the profile of the club can be made such that the peripheral or perimeter weighting can be increased toward the base of the club. In this manner, the peripheral weighting allows the effective hitting area to be lowered on the club for more accurate and favorable shots. This is particularly helpful during certain iron shots in order to allow for proper contact of the club head against the ball.

The method for making the club through the process is enhanced by means of a method which specifically directs itself toward the provision of readily finding the center of moments of the club head. This is based upon an impact means that provides certain impacts. The impacts are read on the club head in a manner whereby torque or moment forces are transduced with respect to the heel and toe, as well as the top and base of the club.

The impacts can be derived to form an output from the transducer to a readout. This readout can be with either a digital readout to zero out the relationship of the transducer sensing off center moment impact, or the output can be provided on a tube such as a cathode ray tube or oscilloscope.

The foregoing club and method of manufacture of the club is deemed to be novel over the prior art and specifically allows for the formation of a golf club so that an effective hitting area (sweet spot) can be effectuated and maximized for the benefit of the golfer.

SUMMARY OF THE INVENTION

In summation, this invention comprises a peripherally weighted golfing iron having a cavity with a cover plate thereover wherein the interior is filled with foam, and includes a method for making, and establishing the effective hitting area of the club.

More particularly, it comprises a golf club having a design wherein the weight of the club is established away from an open cavity. The open cavity is covered by means of a welded cover. The cavity is filled with a foam, such as a urethane foam, and sealed by means of a plastic plug or other type of plug within the cover. The entire club is such that the peripheral weighting is designed to establish a center of moments or effective hitting area (sweet spot) of an improved scope and overall capability.

The peripheral weighting can be enhanced by lowering the weighting to the base of the club so that certain irons will strike a ball at a more favorable effective hitting area that is lower on the club.

The method of manufacture of the club is such that it provides for a peripheral weighting to optimize the maximum placement of the effective hitting area or center of moments of the club. This effective hitting area or center of moments of the club is provided uniformly for a set of clubs.

The investment casting for the manufacturing provides a core which is removed from the club, leaving a seat after casting to provide for a placement of the cover over the opening of the club. The club is then filled with foam and the cover over the interior of the club is provided with a plug therethrough in order to seal the foam within the club.

The method of establishing the effective hitting area is provided by an impact means against the club head. The impact is read as an either on-center of off-center reading from the center of moments by means of a transducer connected to the shaft.

The shaft connected transducer has sensors which sense offsets through the impact on the head to provide for a reading when such offsets are encountered. When the offsets are not encountered and the reading shows the impact taking place at the center of moments, or the effective hitting area, the club is then appropriately marked for that respective hitting area.

The foregoing thereby provides for a uniform establishment of the effective hitting area of a club through the impact means and transducer of this invention, as well as for a club with an improved overall design function, and method of manufacture.

BRIEF DESCRIPTION OF THE DRAWINGS

The invention will be more clearly understood be reference to the description below taken in conjunction with the accompanying drawings wherein:

FIG. 10 shows a view of the means and apparatus for providing the method of establishing the effective hitting area;

FIG. 11 shows a view along lines 11—11 looking at the transducer and clamp that holds the golf club shaft to establish the impact thereon; and, FIG. 12 shows a side view of the transducer in the direction of lines 12—12 of FIG. 11.

PREFERRED EMBODIMENT

Figure 1:
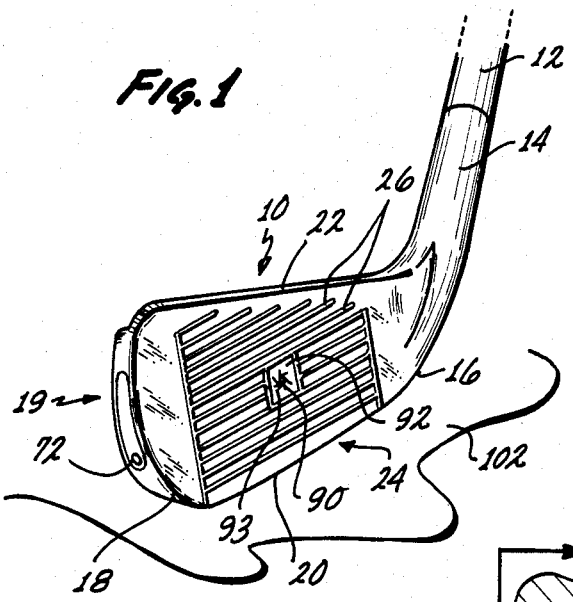
FIG. 1 shows a perspective view of the club head of this invention with a golf club shaft in fragmented relationship within the club head.

Looking more particularly at FIG. 1, it can be seen that a golf club head 10 has been shown connected to a shaft 12. The head 10 has a hosel 14 which receives the shaft 12. The shaft 12 can be in the form of any metal or wooden shaft or other material that extends upwardly to a grip region. The hosel 14 is generally hollow in order to receive the end of the shaft and tapers downwardly to a heel 16 and a toe 18 toward the end area 19 of the club.

The club head also has a base 20 and an upper or top portion 22. This particular club is an iron. The iron has a ridged face 24 comprising a number of ridges 26 on the face thereof. These ridges 26 on the face can be imposed by any machine process or technique providing a textured or relieved area that will facilitate a degree of frictional engagement with the ball when it is struck.

The respective heel and toe portions 16 and 18, and general end area 19 are formed in a manner whereby they are curved to allow for a certain degree of forgiveness when the club is struck and hits an object that is not meant to be hit. In this manner, the center portion of the club 26 is generally the lowest portion of the club and follows a generally curved configuration from the heel 16 to the toe 18.

The club has an interior opening or cavity 28. The interior opening 28 is formed by way of an investment casting having a core approximating the outer periphery of the opening 28. The outer periphery can be seen at the top as the peripheral region 30 and the lower peripheral region 32. These two peripheral regions around the opening or cavity 28 that are provided by the investment casting core are the outer limits of the club interior cavity 28.

This cavity 28 is formed with a taper so that the outer periphery thereof formed by peripheral areas 30 and 32 of the cavity tapers to a rounded end 36. The rounded end 36 is such that a core during the casting process fits therein and is capable of being withdraw on a tapered basis outwardly in the direction of line 38. The withdrawal of the core during the investment casting process is easily accomplished by virtue of the fact that it is withdrawn from the smaller into the larger dimension which is fundamentally the expanded periphery 30 and 32 from the rounded end 36.

When the opening or cavity 28 is cast with the core therein, the core defines three ridge-like portions.

In particular, an upper ridge-like portion 42 is cast on the upper peripheral area 30. In addition thereto, a back ridge 44 is cast and a front ridge 46 is also cast. These respective ridges 42, 44 and 46 are indented so that they do not terminate at the general end of the club 19 or toe portion 18.

In particular, it can be seen that the end of the club 19 or toe portion 18 is defined by a peripheral line 50. This peripheral line 50 is such that the ridges 42, 44 and 46 are placed backwardly or indented therefrom to allow a space 52 and 54 from the respective ridges 42 and 44.

These spaces 52 and 54 allow for a seating of an end cap or plate 56. The end cap or plate 56 is seated against the ridges 42, 44 and 46 and held in place for securement thereby. In effect, the terminal points of the ridges or splines 42, 44 and 46 provide a seat against which the end plate or cap 56 can be seated. This seating allows for a marginal implacement of the plate or cap 56 thereagainst, so that the outer surface of end cap 56 is formed as a continuation of the peripheral line 50 of the end of the club 19 or toe 18.

The end cap 56 is subsequently welded in place against the seat provided by the ends of ridges 42, 44 and 46 and is held in firm relationship within the entire club by the seats provided thereby.

Figure 9:
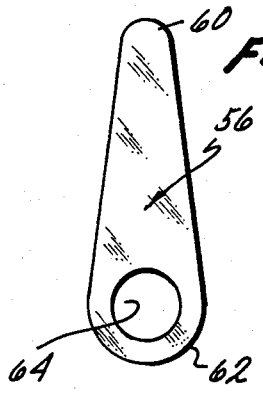
FIG. 9 shows a view of the end cap to cover the cavity of the golf club.
Figure 2:
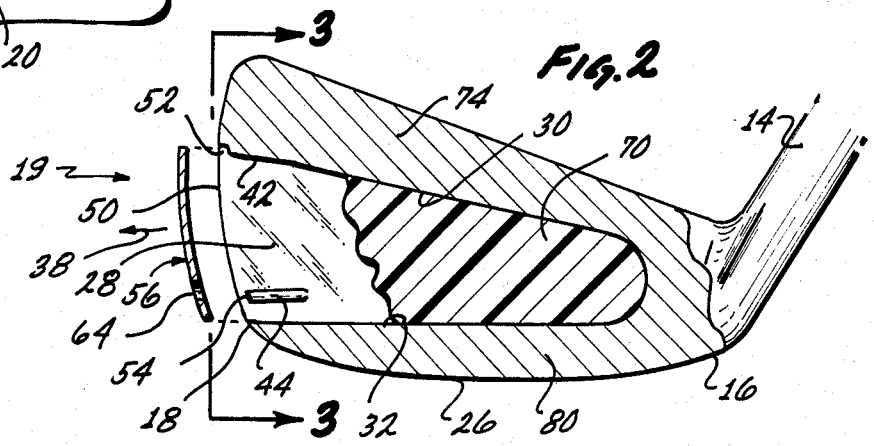
FIG. 2 shows a midline sectional view of the club head.
Figure 3:
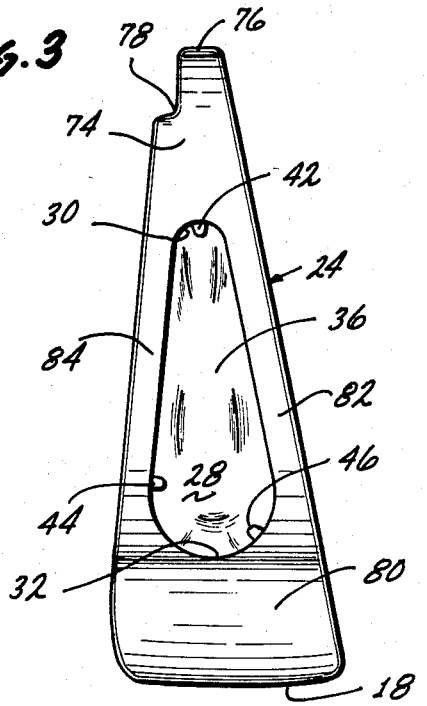
FIG. 3 shows an end view of the club head as seen in the direction of lines 3—3 of FIG. 2.
Figure 4:
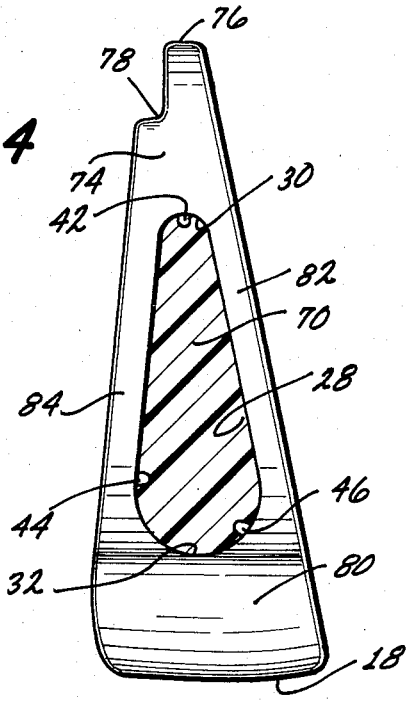
FIG. 4 shows an end view of the club head with the foam therein.

The end plate 56 can be seen in greater detail in FIG. 9 on its frontal portion thereof. The frontal portion thereof comprises a generally triangular shape on the front elevation thereof. This triangular front elevation portion terminates in a narrow portion 60 and expands outwardly to a lower portion 62. These two respective portions define a rounded triangular member having an opening 64 at the larger portion thereof. The opening 64 is for purposes of providing the foam in the cavity 28 of the club as will be described hereinafter.

The opening 64 in the end plate 56 allows for a filling of plastic foam into the cavity 28 of the club. This takes place after the cover or plate 56 has been welded in place and the club is substantially finished.

It can be seen that a foam 70 has been implaced in the cavity 28 to completely fill the cavity. This particular foam is a urethane foam that fills the cavity and provides for a complete orientation of the foam within the cavity out to the periphery such as the peripheral boundary 32 and the line established by the plug or end cap or plate 56. The entire club is filled with foam 70 to give it a solid and firm impact upon hitting the ball. Also, it tends to provide for resilient reinforcement of the peripheral weighted aspects of the club.

In order to seal the end of the club at the opening 64, an epoxy plug 72 can be utilized. The epoxy plug 72 can be substituted by any suitable plug means, such as a screw, a metal insert, or other plastic means. However, it has been found that the epoxy allows a finished appearance while at the same time providing the particular weighting characteristics and strength that is desired.

As can be seen from the drawings, the rounded end 36 of the perimeter weighted club terminates in the heel portion 16 and provides for a smooth withdrawal of the core when the investment casting is made forming the iron. Although certain configurations can be used other than the given configuration, it has been found that this configuration is most suitable for the peripheral weighted iron forming this club.

In reference to the peripherally or perimeter weighted iron of the club, it can be seen that a major boundary region at the top of the form of metal portion 74 is seen. This metal portion 74 terminates in an upper surface at the top of the club, namely upper surface 76 in a narrow ridge, thereby providing a ledge 78.

The base of the club 18 includes a substantially weighted metal portion 80. The substantially weighted portion 80 is heavier insofar as the entire club is concerned than the other portions of the periphery or perimeter weighted club.

The face portion 24 has a minor wall 82 that is of substantially the same thickness as the rear wall 84. These two respective wall portions provide for a perimeter weighting away from the axial center of moments. However, the main perimeter weighting is provided by the upper metal portion 74 and the lower metal portion 80. These two respective portions provide the center of moments at the center 90 shown on the club with a general starburst configuration. This point 90 is the general center of moments for an area where the moment of force or torque applied generally is equally distributed throughout the club head.

On the club face 24 is a general area that can be defined as the effective hitting area. This is generally shown as the square portion 92 or area defined proximate the points of the star design 93. The effective hitting area 92 diminishes in its ability to provide an effective hitting area the farther away from the point 90 that it extends. Accordingly, the effectiveness of the hitting area diminishes the farther away it gets from the center of moments at point 90.

This particular aspect of the center of moments 90 and the effective hitting area 92 provided by the peripheral or perimeter weighted club will be defined hereinafter with respect to the action of the ball and the establishment thereof.

Figure 5:
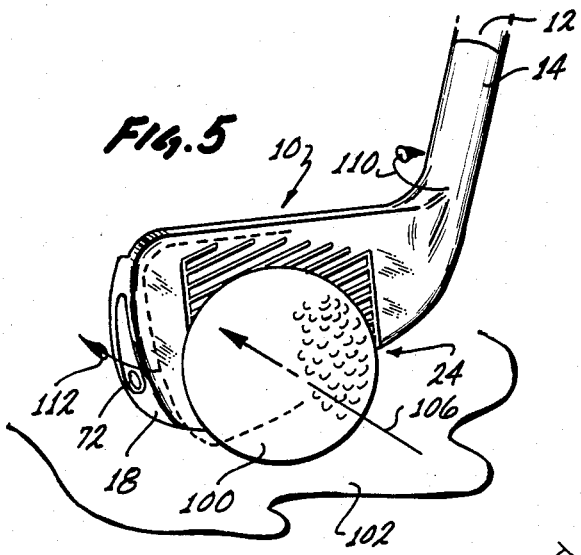
FIG. 5 shows the club head impacting a golf ball toward the toe thereof and a diagrammatic representation of the torque which is received due to the offset impact from the center of moments.
Figure 6:
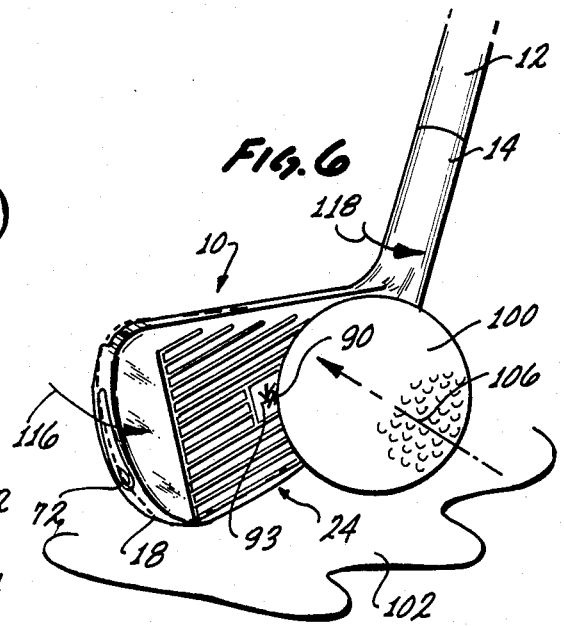
FIG. 6 shows a golf ball impacting the heel of the club and the arrows thereof showing the offset impact that torques the club around the center of moments.
Figure 7:
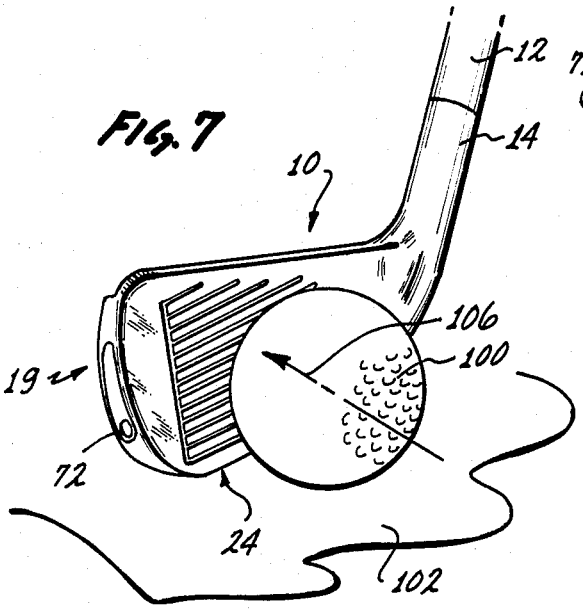
FIG. 7 shows a view of a golf club hitting the golf ball within the effective hitting area or center of moments whereby little or no torque is established.

Looking more particularly at FIGS. 5, 6 and 7, it can be seen that a golf ball is being struck by the club face 24. In particular, the club head 10 is striking a ball 100. The ball 100 is placed on a surface such as surface 102 or can be placed upon a tee. Regardless of how the ball is supported, it can be seen that it is being struck so that it takes place at an impact point which passes through the center of mass of the ball 100. The impact point passing through the center of mass is defined by an arrow 106.

The arrow 106 as can be seen in FIG. 5 showing the striking point, is substantially at the toe 18 of the club. It is roughly centered in the middle of the club but nevertheless is at its toe. This particular effect causes the club to torque or move around the shaft 12 in the direction of arrows 110 and 112. This movement from the center of moments in the direction of arrows 110 and 112 creates a situation wherein the face of the club, namely face 24, serves to direct the ball in a manner providing both spin an indirect movement to the point where the ball moves off the proper line of flight.

FIG. 6 shows the impact point toward the heel 16 of the club. This impact point causes rotational moments of force to be exerted around the center of moments so that shaft 12 is caused to rotate. These directional moments or torque forces are in the direction of lines 116 and 118. Thus, the heel 16 tends to move in a manner whereby it is moved backwardly while the relationship of the club around the shaft 12 tends to rotate in the direction of arrows 116 and 118. This also causes the ball to be driven in an improper direction with a particular spin action around the spin axis or moment of inertia of the ball 100.

FIG. 7 shows the ball 106 being impacted at the center of moments 90 or within the effective hitting area 92. The foregoing respectively imparts little or no torque to the shaft 12. Accordingly, the flight of the ball is substantially in a line of flight that is proper without any particular spin action around the moment of inertia of the club. The action on the ball is generally the loft provided by the angle of the face 24 and the respective grooves 26, that also impart the spin and loft to the ball that is preferred for that particular club.

Figure 8:
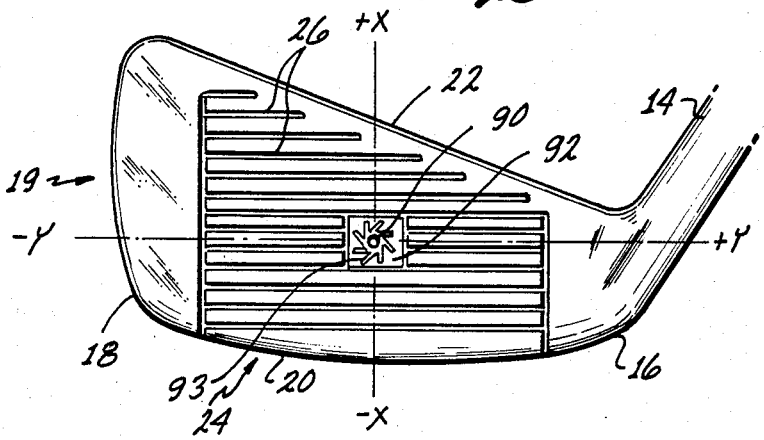
FIG. 8 shows a view of the face of the golf club in a manner that illustrates the movement of the center of moments or effective hitting area.

Looking more particularly at FIG. 8, it can be seen that a plus X axis and minus X axis have been established as well as a plus Y axis and a minus Y axis. These four respective axes pass through the center of moments of the club. When the center of moments is moved along the respective Y or X axes, a moment of force is imparted away from the center of moments 90 so that the club has a tendency to turn. To avoid this, the club is peripherally weighted by the mass 74 and 80 being established in a peripheral or perimeter area outside of the center of moments.

In the given club design for manufacture, the center of moments can be moved about more readily with removal or replacement of mass 74 and 80 than would be required if the club were solid. In other words, in order to move mass with a solid club to balance the club with regard to center of moments, mass from the center must be compensated for with substantially greater mass toward the periphery.

With the void or cavity 28 being established, the movement of the mass is more effectively controlled so as to impart the center of moments in the correct area of the club. Thus, it is easy to move the center of moments 90 up and down the X axis which is sometimes preferred with regard to various clubs that are used by certain people, such as amateurs and professionals due to the way they swing.

In addition thereto, movement along the Y axis can take place more readily by virtue of the hollow cavity 28 being oriented in a manner whereby the mass can be moved to and from the heel or more toward the toe, respectively 16 and 18.

In order to establish the center of moments, an impact means is utilized. This impact means is seen more readily in FIGS. 10, 11 and 12.

FIG. 10 shows a perspective view of the method and apparatus for developing the center of moments of the club of this invention. The apparatus comprises a base 130 that supports an L shaped member having an upright portion 132 and a horizontal portion 134 attached to the base. The upright portion 132 has a terminal end 134 which supports a transducer box 136. The upright 132 has an intermediate clamp or rest 138 which holds the golf shaft 12 in substantially arrested relationship thereto, for preventing substantial swinging movement thereof.

The head of the club 10 is allowed to rest freely without touching the ground. It is supported in its upper end by a handle 140 of the club shaft 12 being supported in a frictionally engaging yoke 142. The frictionally engaging yoke 142 comprises a resilient U shaped member having uprights 144 and 146 that terminate in a transverse member 148.

The resilient U shaped yoke 142 is made of a plastic or other resilient material such as spring steel to hold the golf club handle 140 therein. In this manner, it is secured and transmits any moments of force through the handle 140 or golf grip to the yoke 142. The yoke 142 is supported by means of a cross member 150 within the transducer box 136. The cross member 150 connects the yoke 148 by means of the upright member 152 which connects to a second cross member 154.

The second cross member 154 supports a pair of transducers 156 and 158. The transducers 156 and 158 in this case comprise a spool 160 of a coil having a stem or rod 162 extending therefrom with a magnetic excitation means. The stem or rod 162 is affixed within the cross member 154 so that vibrations and movements through upright 152 extend from the yoke 14 and are transmitted thereto.

These particular forces on the stem or rod 162 extending from transducer 158 allow for imparting the force thereon which is seen through the shaft 12 that is connected to the head 10.

The head 10 is shown in proximate relationship to a vibratory or impact hammer means 170. The impact hammer means 170 is connected by a cord 172 to an electrical output within a box 174. The box 174 allows an electrical output to be imposed on the impact means 170 so that impact can take place, or vibratory modes can take place at the point 178 of the impact means 170.

In this particular instance, it is seen that the golf club head 10 has been impacted at an off-center location 180 as opposed to the center of moments 90. An output is registered on an oscilloscope screen 194 in the form of an offset lined reading 196 and 198. These readings correspond to the transduced signals that are received from the vibratory mode vibrating the rods 162 and attendantly generate an output through coils 160 on lines 200 and 202.

When the impact means 170 is driven against the center of moments 90, the transducers and in particular the rods 162 with the magnetic excitation means and the coil 160, do not provide any kind of output from the standpoint of an electrical signal. Accordingly, the oscilloscope screen 190 does not register any offset in the way of lines 196 and 198 but holds to a line 210 which is analogous to the center of impact or the center of moments 90. In effect, when the center of moments 90 is being impacted the oscilloscope only traces along line 210.

The foregoing is accomplished by circuitry connected to the output of lines 200 and 202. This circuitry comprises a means for receiving the signals on lines 200 and 202 that correspond to vibratory modes on the yoke 142 that is seen on the shaft 12. These particular outputs are sensed on a board and are then either amplified or conditioned so that they provide for a trace on a screen, analogous to the trace 196 and 198.

The circuitry and screen in its normal operation when there is an impact on the center of moments 90 on the club, traces along line 210. This thereby shows that the center of moments or effective hitting area (often referred to as a sweet spot) has been established for that particular club.

Such a club can then be manufactured in quantity if the same weighting on the periphery such as peripheral weighting area 74 and 80, are constantly maintained. In most cases, this can be done with a known investment casting having known densities of the metal being used therewith. Also, if the known densities of the foam 70 that is imparted therein is maintained, the continuity providing the center of impact 90 and an analogous effective hitting area, described roughtly by the area therearound, such as area 92, can be maintained on a consistent basis for a set of clubs. This allows the manufacturer to provide for a complete set of clubs that are maintained within an effective hitting range, and in particular proximate the center of moments thereon.

Any particular transducer can be utilized other than the coils shown with the rods 162 and magnetic excitation means therethrough. For instance, magnetic deflection, hall effect switches, capacitive and inductive transducers indicating movement, or any other kind of movement indicator wherein and electrical signal can be implaced upon lines 200 and 202 can suffice.

Accordingly, the mode of transduction from the vibratory mode of the club head 10 through the handle 140 can be ascertained by any particular transducer, so long as the output can provide a signal to apprise a person of when the center of moments has been impacted. Furthermore, digital readout means, such as those means providing a base line of one hundred or zero or any other base line to show the center of moments having been impacted or an off-center impact can be established, rather than the oscilloscope screen 194 as shown herewith.

It should be understood that various embodiments of this invention providing the peripheral weighting can be resorted to. Also, other than the means shown can be used to provide the center of moments, as long as a reading can be established so that the effective hitting area can be maintained and the attendant center of moments can be established for the attendent effective hitting area. Accordingly, this invention should be read broadly in light of the following claims hereinafter.

I claim:

1. A metal iron type golf club designed for minimizing offsets from the center of moments and torque when the club strikes a ball comprising:

a golf club having a heel and toe wherein the heel has a hosel extending therefrom adapted to receive a shaft therein:

a cavity within said club surrounded by at least a portion of the metal weight of said club established within a perimeter region outside of said cavity and wherein said perimeter region and said cavity extend from said toe toward said heel in a diminishing manner as to its overall cross sectional size and said cavity is closed from communication with said hosel;

means for closing said cavity formed as a plate welded to said club and overlying said cavity formed with an opening therethrough passing into said cavity;

means in said cavity for displacing a portion of said cavity and formed of a mass of plastic foam larger in size than the opening in said plate and having properties which enable said foam to be implaced through the opening of said plate; and, means in said opening in said plate for sealing said foam within said cavity.

2. The golf club as claimed in claim 1 wherein:

said foam is a urethane foam.

3. The golf club as claimed in claim 1 wherein:

said club cavity has indented seating means for receiving the welded closure thereagainst.

4. The golf club as claimed in claim 1 wherein:

said center of moments on the face of said club is established in an area overlying said cavity and is appropriately marked to provide an effective hitting area to avoid torque from offsetting said club when said club strikes a ball.

5. The golf club as claimed in claim 4 wherein:

said center of moments is established in a manner so that there is a substantially greater amount of weight toward the base of said club below said cavity so as to move the center of moments downwardly with respect to the face of said club while still being retained in overlying relationship to said cavity.

* * * * *